United States Patent [19]

Santhanam et al.

[11] Patent Number: 4,721,420

[45] Date of Patent: Jan. 26, 1988

[54] PIPELINE TRANSPORTATION OF COARSE COAL-LIQUID CARBON DIOXIDE SLURRY

[75] Inventors: Chakra J. Santhanam, Lexington, Mass.; Richard W. Hanks, Orem, Utah; R. Peter Stickles, Concord, Mass.

[73] Assignee: Arthur D. Little, Inc., Mass.

[21] Appl. No.: 771,851

[22] Filed: Sep. 3, 1985

[51] Int. Cl.[4] ..... F17C 7/02

[52] U.S. Cl. ..... 406/197; 406/47

[58] Field of Search ..... 406/197, 46, 47, 49

[56] References Cited

U.S. PATENT DOCUMENTS 3,073,652 1/1963 Reichl ..... 406/197 X
3,637,263 1/1972 Wasp ..... 406/197 X
4,206,610 6/1980 Santhanam ..... 406/197 X
4,525,173 6/1985 Baker et al. ..... 406/49 X

*Primary Examiner*—Andres Kashnikow
*Attorney, Agent, or Firm*—Bacon & Thomas

[57] ABSTRACT

A method and composition are provided for transporting coarse particles of coal in a dense liquid $CO_2$ media. The dense media contains fine particles of densifying material such as coal or magnetite which form a suspension in the liquid $CO_2$. The suspension is capable of supporting large particles of coal for transportation in a liquid $CO_2$ slurry pipeline. Use of the dense media allows the pumping of the coarse coal particles at slower velocities than if the fine densifying particles were not present.

5 Claims, 3 Drawing Figures

PIPELINE TRANSPORTATION OF COARSE COAL-LIQUID CARBON DIOXIDE SLURRY

BACKGROUND OF THE INVENTION

1. Field of the Invention

Coal is an important fuel for the generation of power and its continued use for this purpose depends in part on the inexpensive availability of coal at the various power plants located throughout the country. A determining factor of the cost of the coal at the site of the power plants is the cost and equipment needed to deliver the coal to the site.

In the past, various types of delivery systems have been devised to maximize the economic advantages of coal usage. Rail, truck and barge delivery have been in use for many years but these modes of transportation have been recently giving way to more economical transport by means of pipeline. One such pipeline transportation method utilizes coal in the form of a coal/water slurry which is pumped through the pipes to the point of usage, i.e., power plant. While numerous economic and environmental advantages have been realized by coal/water slurry pipeline transportation, they all suffer from the fact that the presence of water, which cannot all be easily removed, materially decreases the overall Btu content of the coal since the substantial portion of its heating value must be expended to vaporize the water.

More recently it has been proposed to transport finely pulverized coal in a coal/liquid $CO_2$ slurry. This technique has offered certain benefits over the coal/water slurry method since it lacks the presence of energy wasting water. In addition, the use of liquid $CO_2$ made the slurry easier to pump and hence lowered the delivery costs. However, the ease of pumping was only achieved by keeping the particle size of the coal very small. For example, in U.S. Pat. Nos. 4,206,610 and 4,377,356, the particle size had to be such that they would pass through a U.S. 50 mesh, i.e., the particles had to be no greater than 300 microns in diameter.

The small particle size limitation requires specialized equipment to pulverize the coal at the site of mining as well as specialized equipment to separate the small particles from the liquid $CO_2$ at the site of use. For this reason the fine particle size slurry method does not lend itself for easy integration with existing wash plants, mines and boilers. Also, additional energy is needed to pulverize the coal to the necessary small particle size. Furthermore, the use of a fine particle size slurry does not easily lend itself to optional transportation by rail truck or barge. Thus, less options are easily available when using the fine particle size slurry which can be disadvantageous in the event that there is a pipeline failure.

Attempts have been made in the past to avoid the problems associated with small particle size slurries by using large particles of coal. However, these prior attempts to use pipeline transportation technology to transport large or coarse particles of coal in liquid $CO_2$ have not been met with success. The movement of larger more coarse particles of coal usually requires higher velocities in the pipeline than that required for small particle size slurry transportation.

These higher velocities greatly increase the amount of energy needed for pumping and considerably increase the wear in the pipeline which occurs at the higher velocities. Therefore, there still exists the need in the art to expeditiously transport coal by pipeline which utilizes large particles of coal so as to avoid the problems associated with small particle size slurries and which also avoids the large energy requirement and wear associated with present large particle size pipeline transporation techniques.

SUMMARY OF THE INVENTION

This invention provides a method of transporting large particles of coal in a liquid $CO_2$ slurry which avoids the above mentioned problems associated with prior art methods and which additionally provides certain advantages not achieved in the past.

The method utilizes a pumpable mixture of coarse coal particles in a heavy or dense liquid $CO_2$ slurry media. The dense liquid $CO_2$ slurry media contains very fine particles of coal or other suitable material which makes the $CO_2$ slurry sufficiently dense to carry large or coarse particles of coal at lower velocities than achievable without the use of the densifying fine particles. The fine particles used to densify the liquid $CO_2$ are ground to a size which is considerably finer than the finest size of coarse coal being transported by this invention.

The basic approach is to form a dense media having a density such that the coarser coal particles can be transported at the normal velocities currently used in fine particle size slurry pipeline transportation and thus provides some of the advantages of slurry pipeline technology as applicable to fine coal. This requires the use of small particles of densifying material which are ground to a fine size capable of forming a suspension in the liquid $CO_2$ such that the particles do not quickly settle out of the liquid $CO_2$. It is preferable that the densifying particles be small and added in an amount to form the suspension in the liquid $CO_2$ such that the coarse particles may be transported at velocities which are comparable to the velocities used in transporting fine particles of coal in a liquid $CO_2$ slurry.

The densifying particles may be coal or other particulate material which is relatively inert in the liquid $CO_2$ and which is capable of raising the density of the media. Magnetite is particularly suitable for this purpose since it is quite dense with a specific gravity of 5.2 (molecular weight=233.6). The use of densifying material having a high specific gravity is particularly useful since this type of material can provide a broader range of densities obtainable in the heavy media. Thus, magnetite can provide a very dense media at relatively low concentrations. The density can also be increased tremendously by using a high concentration of magnetite. This is advantageous since the ability to form a very dense media allows the fairly large size distribution of coarse coal particles to be transported, including coal particles up to 2 inches. Magnetite is also advantageous since it can be separated from the media or coal by means of magnetic forces.

While coal has been described as the type of coarse particles to which this invention applies, it is within the scope of this invention to transport other types of coarse particles in a densified liquid $CO_2$ media. Thus, other articles and comminuted materials such as granulated solids and grain can be transported by the method of this invention. Thus it is contemplated to substitute the coarse coal with any of these materials.

The amount of heavy media may be within a wide range depending on the type and size of coarse particles to be transported. Generally, the media will contain 30–50% by weight solids with the remainder comprising liquid $CO_2$.

In operation, the broad aspects of the invention involve incorporating coarse coal into the dense media to form a slurry. The coal is preferably dried before mixing it with the dense media and may, therefore, be subjected to a conventional drying operation before the slurrying step. The amount of coarse coal which is incorporated into the dense media and transported by this process is preferably 40–60% by weight. The exact maximum will, of course, be sensitive to the properties of the coarse particles being transported and the size distribution of those particles. The coarse coal/liquid $CO_2$ slurry is pumped through a pipeline while maintaining the temperature and pressure to keep the $CO_2$ in the liquid state. Once the coarse coal/liquid $CO_2$ arrives at the final destination, such as a power plant, the coarse coal is separated from the dense media. The dense media is recirculated back to be slurried with additional coarse coal for transportation. Make-up $CO_2$ may be obtained from the stack gases obtained from the power plant and the dense media may be deslurried to recover the fine coal whenever the content of the fine coal becomes too high due to unavoidable attrition of the coarse coal particles.

The present invention departs from the prior art method of fine particle coal/liquid $CO_2$ pipeline transportation primarily in the use of large particles of coal and a fine particle densifying material to enable the large particles to be transported in a manner similar to the coal/liquid $CO_2$ pipeline transportation as described in applicant's prior U.S. Pat. Nos. 4,206,610 and 4,377,356. While this departure will require some structural modifications at either end of the pipeline (i.e., mining and power plant end) the basic technology relating to the pumping, slurrying, forming liquid $CO_2$, choice of structural materials, operating conditions etc. have many points in common with the coal/liquid $CO_2$ technology described in U.S. Pat. Nos. 4,206,610 and 4,377,356, and for that reason both of these patents are incorporated herein by reference.

The present invention is an enhancement of liquid $CO_2$ slurry technology and this enhancement permits the direct integration of this enhanced technology with existing wash plants, mines and boilers which are presently adapted to deal with fine particle coal/ liquid $CO_2$ technology. Additionally, this enhancement permits interface with alternative means of coal transportation, such as rail, truck and barge, since both this invention and these alternative means of transportation use relatively large particles of coal.

It is an object of this invention to provide an inexpensive method of transporting large particles of coal as large as about 2 inches in diameter by means of a dense liquid $CO_2$ slurry in a pipeline which does not require high flow velocity.

It is a further object to provide a system of moving large particles of coal or other materials which can be directly integrated with existing wash plants, mines and boilers which are currently adapted to fine particle coal/liquid $CO_2$ slurry technology.

A further object is to provide a liquid $CO_2$ slurry transportation method of moving coarse coal or other particles which can be interfaced with optional secondary modes of transportation such as rail, barge or truck.

A further object is to provide a composition for the pipeline transporation of coarse coal.

These and other objects of the invention will become apparent to those skilled in the art.

DETAILED DESCRIPTION OF THE PROCESS

The objects of this invention are accomplished by transporting large or coarse particles of coal in liquid $CO_2$ which has been made dense by the incorporation therein of fine particles of densifying material such as coal or magnetite.

Figure 1:
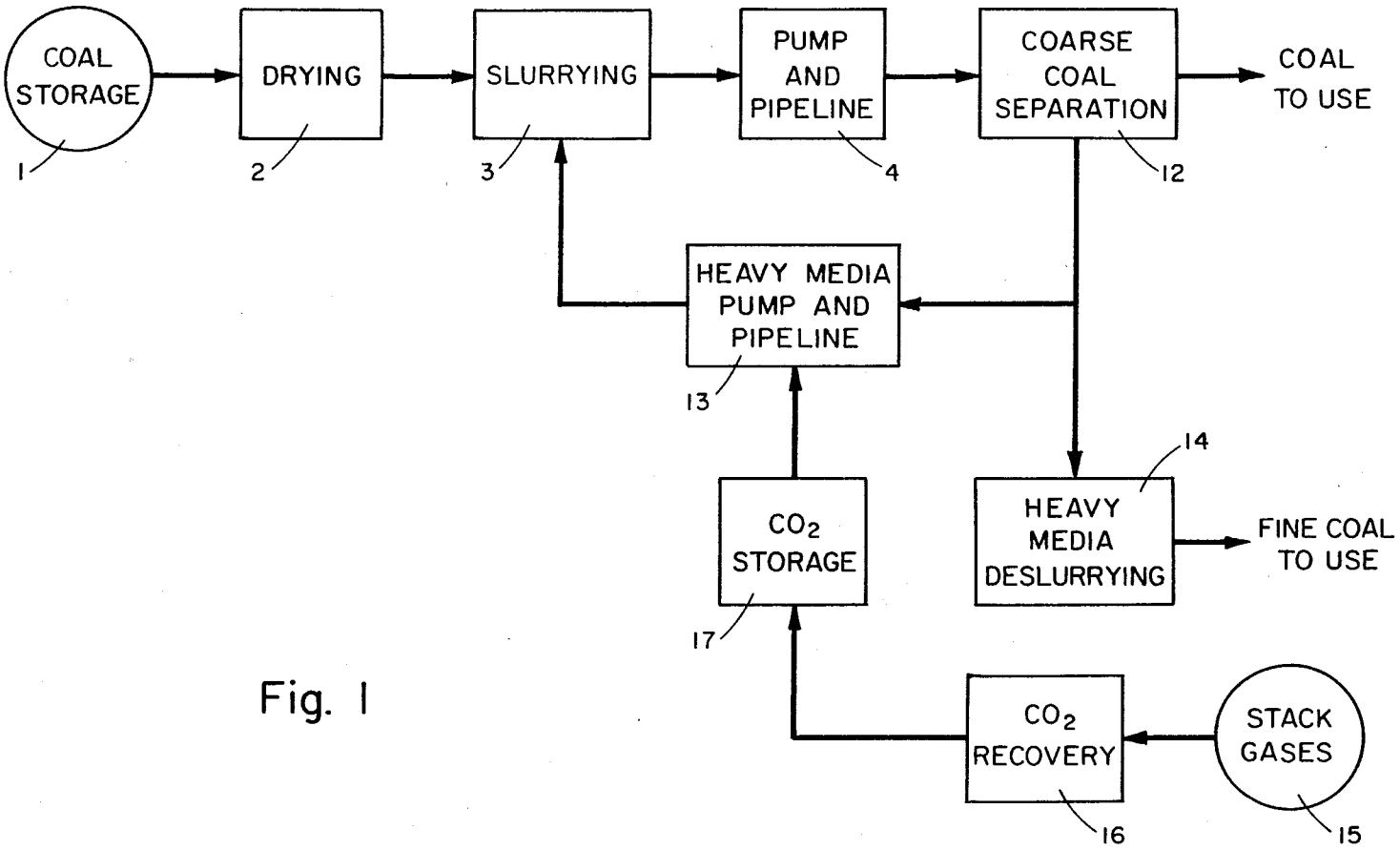
FIG. 1 is a schematic diagram representing an overview of an embodiment of the process which utilizes fine particles of coal as the densifying material.
Figure 2:
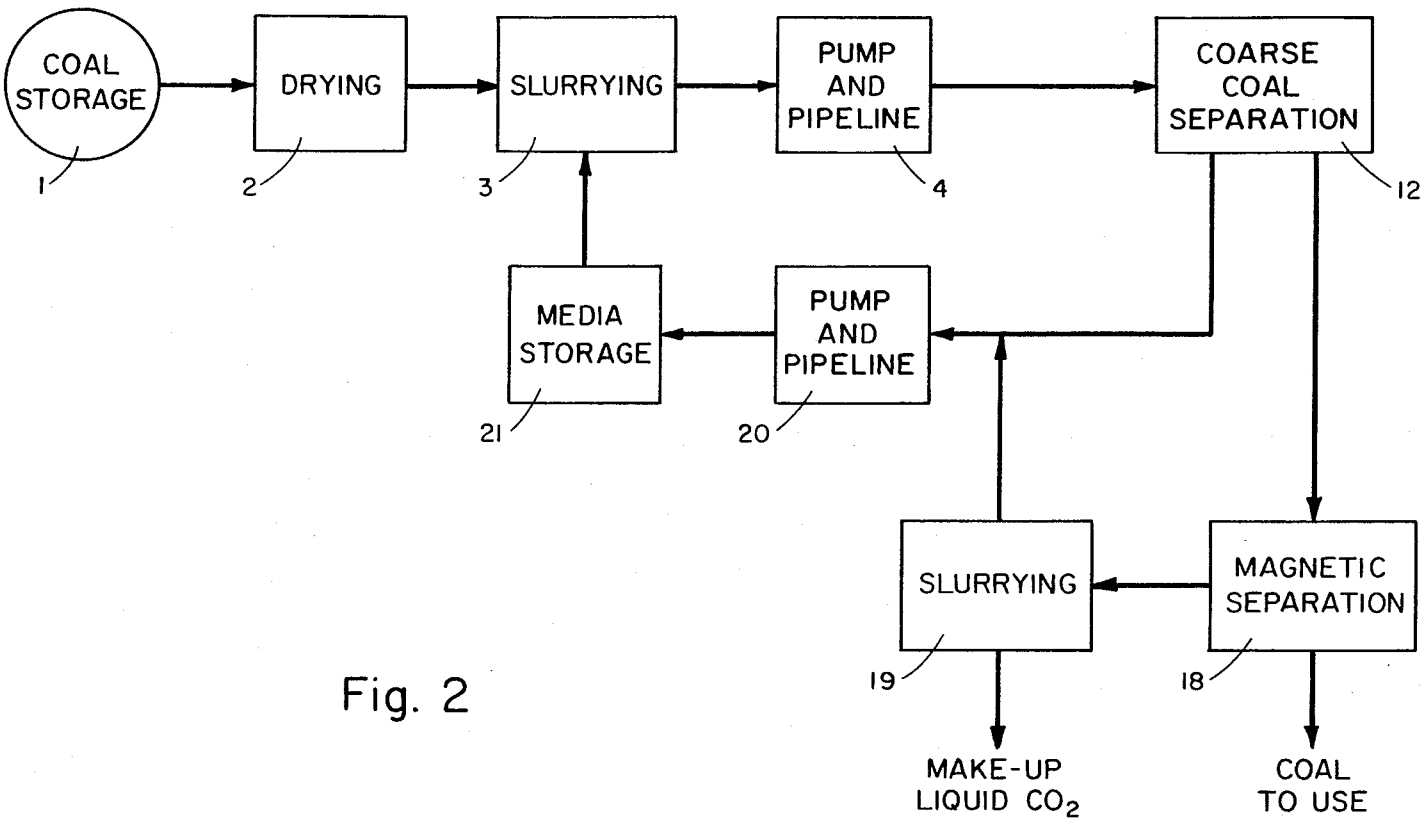
FIG. 2 is a schematic diagram representing an overview of an embodiment of the process which uses fine particles of magnetite as the densifying material.
Figure 3:
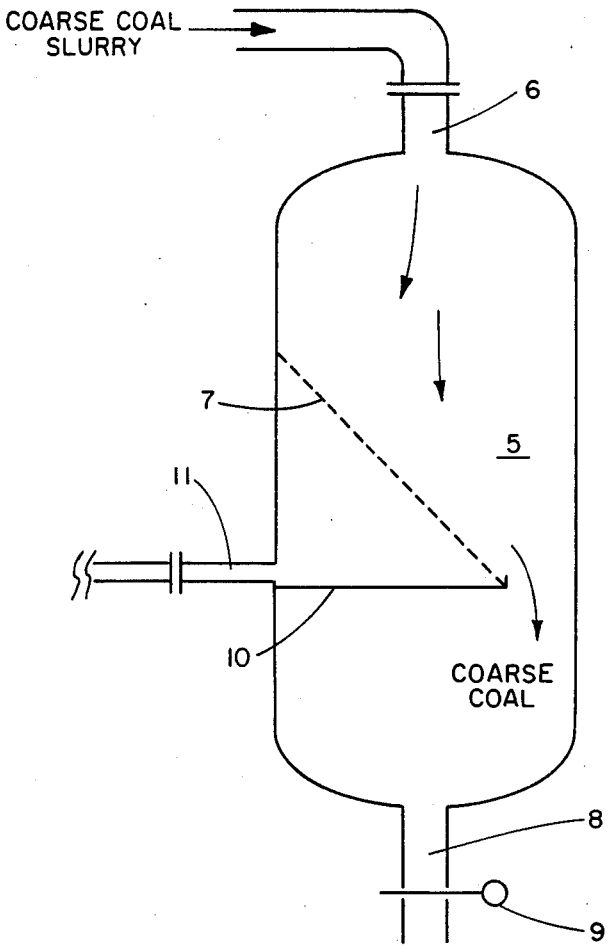
FIG. 3 illustrates the internal structure of one type of coarse coal separation unit which may be used in conjunction with this invention.

To further the understanding of the details of this invention as well as the preferred embodiments thereof, reference is made to FIGS. 1, 2 and 3.

In operation, the particles of coal are first obtained from a mining and crushing operation to provide coarse coal particles which are distributed within an acceptable size range. Although the coarse coal particles being transported may contain many different particle sizes within the acceptable range, it is also possible to transport uniformly sized particles. In any event, the benefits of this invention are realized when the largest particles being transported are larger than the largest particles which are used in fine particle size coal/liquid $CO_2$ slurry pipeline transportation. For that reason, the largest particle should be too large to form a stable slurry in liquid $CO_2$, i.e., larger than the largest particles which will not settle out to any appreciable degree. Thus the largest sized particles of the coarse coal should be too large to pass through a 50 mesh screen, i.e., larger than 300 microns.

Although the coarse coal will contain particles larger than 300 microns, the presence of smaller particles along with the larger ones is acceptable. For example, coarse coal having a particle size distribution of $-\frac{1}{2}$ inch $+60$ mesh is suitable.

The largest sized particles may be as large as about $\frac{3}{4}$ inches in diameter. However, they may be as large as about 2 inches in diameter when fine particles of magnetite or similarily dense material is used to make the dense media. Typically coarse coal particles of $-\frac{1}{2}$ inch $+1/16$ inch may be used in this process.

The coarse particles are conveniently stored in a conventional storage vessel 1 as shown in FIGS. 1 and 2.

Once a suitable size of coal particles are obtained, they are then dried by conventional apparatus at location 2 to remove any water which may interfere with the transportation process. After drying, the coarse coal particles are then incorporated into the dense liquid $CO_2$ media to form a slurry containing the coarse coal particles. This is illustrated by reference numeral 3 in FIGS. 1 and 2.

The dense media used in the slurry is liquid $CO_2$ containing finely ground coal or other suitable particles which are substantially inert and insoluble. As stated previously, very dense materials such as magnetite are particularly useful.

The densifying material is ground to a size which is considerably finer than the smallest coarse particles of coal being transported. The exact size of the densifying particles is not critical so long as they can form a very fine suspension of particles in the liquid $CO_2$ which do not quickly settle out of suspension. For example, if one wants to transport $-\frac{1}{2}$ inch +60 mesh coal, very finely ground (−325 mesh or −400 mesh) coal or magnetite would be an appropriate size range to form the dense media. Of course, other sizes are contemplated within the scope of this invention so long as they meet the functional limitations of being able to form a suspension of particles which does not quickly settle out in the liquid $CO_2$ such that the dense media can be formed capable of carrying the coarse coal particles through a pipeline.

The amount of densifying material added to the liquid $CO_2$ will affect the overall density of the media. The precise amount added in any particular instance will depend on the weight and size of the coarse particles being transported. It will also depend on the density of the fine particles. For example, the use of a dense material such as magnetite provides a very dense or heavy media at relatively low concentrations. Generallv, the dense media will contain about 30–50% by weight of densifying material. Preferably, an amount of densifying material is added to allow the coarse particles to be transported in a pipeline at normal velocities relative to the velocities currently used in fine particle size slurries.

The coarse coal may be added to the dense media by charging the coarse coal within a certain size distribution (for example $\frac{1}{2}$ inch +60 mesh) into a conventional lock hopper in much the same manner as for fine coal.

After a slurry has been formed containing the coarse particles, densifying material and liquid $CO_2$, it is then pumped into the pipeline numeral 4 for transporation. Preferably, a relatively open impeller centrifugal pump or an axial flow pump is used although other types of conventional pumps may be substituted providing they are capable of handling the coarse materials contained in the slurry.

The pipes used to transport the slurry may be of the type currently used to transport fine particle/liquid $CO_2$ slurries, although larger sizes are preferably used in this invention than those used for the movement of an equivalent amount of fine particle coal.

Once the coarse coal arrives at its destination, it is separated from the dense media. This is shown by numeral 12 in FIGS. 1 and 2. For this purpose, any suitable liquid/solid separating apparatus may be employed. A suitable device is illustrated in FIG. 3. In this device, the coarse coal slurry enters the unit 5 through pipe 6 and falls on an inclined screen 7 sized to prevent the coarse coal particles from passing theretrough. The coarse coal particles collect on the bottom of the unit 5 and exit via pipe 8. The passage of the coarse coal may be assisted by a motorized valve or lock hopper shown by numeral 9. The fine particles of densifying material and liquid $CO_2$ pass through screen 7 onto collector 10 from which it takes it through pipe 11 for recirculation and reuse.

The process steps after the coarse coal separation at location 12 will depend on the type of densifying material used in the system.

When a densifying material such as coal is used, there will be some unavoidable grinding of the coarse coal which will produce additional fine particles and there will also be some loss of the fine coal by merely physical deposition on the coarser particles. Hence, in order to maintain the balance in the whole system, a small part of the heavy media may have to be deslurried by conventional methods to remove any extra fine coal. The relatively small amounts of fine coal that will be produced by such deslurrying can actually be mixed with the coarse coal itself for ultimate use at the receiving end. Similarly, some make up carbon dioxide may be required to account for fugitive losses. Up to 4–8% of the $CO_2$ may be lost in the closed loop system.

It should be noted that in the case of some coals, some provision may have to be made to also add some very fine coal to the system. This can be done at the utility end since it is likely that pulverizing equipment already exists there. However, it can be done at either end.

When materials such as magnetite (which is not combustible) is used, it is desirable to remove the small amount of magnetite which may still be on the coarse coal particles after they are separated from the dense media. To this end, the coarse coal particles recovered at location 12 may be subjected to magnetic separation over a conventional magnetic drum. This will recover the remainder of the magnetite which can be reslurried in make-up $CO_2$ and mixed with recovered dense media for recycling and reuse.

The following nonlimiting examples are given to further illustrate the invention. Example 1 which is given with reference to FIG. 1, illustrates a preferred embodiment which utilizes fine particles of coal as a densifying material to transport coarse particles of coal in liquid $CO_2$. Example 2, which is given with reference to FIG. 2 illustrates another preferred embodiment which utilizes fine particles of magnetite for the same purpose.

EXAMPLE 1

Coal of particle size $-\frac{1}{2}$ inch +1/16 obtained from storage facility 1 and then dried at location 2. The dried coal is then added to dense liquid $CO_2$ containing 30–50% coal particles of −325 mesh size. Sufficient coarse coal is added to the media to yield a slurry containing 40–60% coarse coal by weight which is then pumped through pump and pipeline 4. The slurry is pumped to its destination where the coarse coal particles are separated from the dense media at location 12 by means of the separator illustrated in FIG. 3. The coarse particles of coal are recovered and are in condition for burning in a power plant at this time. The dense media is also recovered at location 12 from the same apparatus where the coarse coal was separated and most of it is recirculated through heavy media pump and pipeline 13 for reuse at slurrying location 3. A portion of the recovered dense media is sent to a heavy media deslurrying device 14 to remove excess fine coal which forms in the system. The excess coal is recovered from the deslurrying apparatus and is used with the coarse particles of coal for burning at the power plant. Stack gases 15, produced from the power plant, are recovered at 16 and sent to storage facility 17 for ultimate use as make-up liquid $CO_2$ in the heavy media pump and pipeline 13.

EXAMPLE 2

Coal of particle size $-\frac{1}{2}$ inch +1/16 inch is obtained from storage facility 1 and dried at location 2. The dried coal is then added to dense liquid $CO_2$ containing 30–50% magnetite particles of −325 mesh size. Sufficient coarse coal is added to the media to yield a slurry containing 40–60% coarse coal by weight which is then pumped through pump and pipeline 4. When the slurry arrives at its destination, the coarse coal particles are separated from the dense media at the location 12 by means of the separator illustrated in FIG. 3. The separated coarse particles of coal are recovered and sent to magnetic separator 18 shown in FIG. 2. The magnetic separator removes the residual fine particles of magnetite to produce coal free of magnetite which can be burned in a power plant. The recovered magnetite is sent to a slurrying apparatus which also receives make-up liquid $CO_2$ obtained from stack gases as in Example 1. The slurry formed at 19 is then combined with the recovered dense media from 12 and the combined slurry from 19 and 12 is sent to pump and pipeline 20 where it is transported to media storage facility 21 for ultimate reuse at slurrying location 3.

While the present invention has been described in terms of certain preferred embodiments and exemplified with respect thereto, one skilled in the art will readily appreciate that various modifications, changes, omissions and substitutions may be made without departing from the spirit thereof. It is intended, therefore, that the present invention be limited solely by the scope of the following claims.

What is claimed is:

1. A method for the pipeline transportation of coarse particles of coal which are too large to form a stable slurry in liquid $CO_2$, comprising the steps of:

(a) slurrying coarse particles of coal up to $\frac{3}{4}$-inch in diameter with a dense liquid $CO_2$ media in an amount of 40–60% of coarse coal particles with respect to the dense media; said dense media formed by incorporating fine coal particles in liquid $CO_2$ in an amount of 30–50% with respect to the liquid $CO_2$; said fine particles capable of forming a stable suspension in liquid $CO_2$ whereby the coarse particles may be transported in the dense media by means of a pipeline;

(b) introducing the slurry into a pipeline; and (c) flowing the slurry through the pipeline.

2. The process of claim 1 wherein the coarse coal particles are $-\frac{1}{2}$ inch $+60$ mesh and the fine particles are $-325$ mesh.

3. The process of claim 1 further comprising the steps of:

(a) separating and recovering the coarse coal from the dense media after the slurry has been transported through the pipeline whereby separate quantities of coarse coal and dense media are obtained; and (b) recirculating the dense media for slurrying with fresh coarse coal.

4. The process of claim 3 which further comprises:

(a) the burning of the recovered coarse coal;

(b) recovering $CO_2$ gas from the burning process;

(c) liquefying the recovered $CO_2$ gas; and (d) using this liquid $CO_2$ to make up for $CO_2$ lost in the process.

5. The process of claim 4 which further comprises removing a portion of the recovered dense media and deslurrying it to recover fine coal.

* * * * *